United States Patent [19]

Kinsey

[11] Patent Number: 4,490,973

[45] Date of Patent: Jan. 1, 1985

[54] FLAMEHOLDER WITH INTEGRATED AIR MIXER

[75] Inventor: James L. Kinsey, Palm Beach Gardens, Fla.

[73] Assignee: The United States of America as represented by the Secretary of the Air Force, Washington, D.C.

[21] Appl. No.: 484,329

[22] Filed: Apr. 12, 1983

[51] Int. Cl.[3] ..... F02K 3/10

[52] U.S. Cl. ..... 60/261; 60/262; 60/749

[58] Field of Search ..... 60/226.1, 261, 262, 60/39.11, 734, 749; 431/350, 351, 354

[56] References Cited

U.S. PATENT DOCUMENTS

| | | | |
|---|---|---|---|
| 2,799,991 | 7/1957 | Conrad | 60/39.72 |
| 3,043,101 | 7/1962 | LeFebvre et al. | 60/261 |
| 3,056,261 | 10/1962 | Krabacher et al. | 60/39.72 |
| 3,698,186 | 10/1972 | Beane et al. | 60/749 X |
| 3,765,178 | 10/1973 | Hufnagel et al. | 60/261 |
| 3,800,527 | 4/1974 | Marshall et al. | 60/39.72 |
| 4,259,839 | 4/1981 | Bayle Laboure et al. | 60/261 |
| 4,315,401 | 2/1982 | Beal et al. | 60/261 |

*Primary Examiner*—Louis J. Casaregola
*Assistant Examiner*—Donald E. Stout
*Attorney, Agent, or Firm*—Donald J. Singer; John R. Flanagan

[57] ABSTRACT

A flameholder in an afterburner incorporates an improved mixer which includes a small duct for capturing a small percent of hot gas stream flow and routing the same outwardly along the gutter of the flameholder for producing a localized increase of the air temperature in the cool fan air stream flow. The mixer also includes a deflector plate for deflecting the hot gas exiting from the duct into the cool air stream flow.

1 Claim, 4 Drawing Figures

FLAMEHOLDER WITH INTEGRATED AIR MIXER

RIGHTS OF THE GOVERNMENT

The invention described herein may be manufactured and used by or for the Government of the United States for all governmental purposes without the payment of any royalty.

CROSS REFERENCE TO RELATED APPLICATIONS

Reference is hereby made to the following co-pending U.S. application disclosing subject matter which is related to the present invention: "Flameholder Stabilization Plate for an Aircraft Engine Afterburner System," by George W. Beal, U.S. Ser. No. 318,652 filed Nov. 5, 1981, now U.S. Pat. No. 4,418,531, issued Dec. 6, 1983.

BACKGROUND OF THE INVENTION

1. Field of the Invention

The present invention broadly relates to combustion stability in the afterburner system of a jet aircraft engine and, more particularly, is concerned with means for providing more stable combustion in the fan stream region of the afterburner during augmentor operation in a turbofan jet engine.

2. Description of the Prior Art

In order to increase the effective thrust of the common turbojet engine, bladed fans have been added to a turbine-driven shaft thereof to effect the flow of a quantity of atmospheric air through an annular passage defined between the turbine and a radially spaced casing added thereto. The turbofan engine, as this combination has come to be known, has been found to be more efficient if the hot gas stream flow from the core engine (the basic turbojet portion of the turbofan) and the cooler air in the fan stream (the air stream forced through the annular passage by the fan) are merged together before explusion through a single discharge nozzle.

To develop still more thrust for takeoff and climb and for periods of dash of the aircraft, it is also advantageous to augment the engine thrust by burning additional fuel in an afterburner. The afterburner would be located in the turbofan engine between the turbine and the discharge nozzle at a desired location for combustion of the hot gas stream flow from the core engine and the cooler fan stream air flow from the annular passage leading from the bladed fan.

However, combustion stability of the additional fuel in the afterburner of a gas turbine engine decreases as the temperature of the inlet fan stream air to the afterburner decreases. This is a significant problem in augmented turbofan engines. To overcome this problem, large, heavy mixers are sometimes used to mix the hot gas stream flow from the core engine with the cooler fan air stream flow.

While combustion stability is improved through use of mixers of such type, other problems are created. In addition to being heavy, these mixers also produce an undesirable total pressure loss. Consequently, a need exists for improvement of the mixing of the hot core gase stream with the cooler fan air stream in a manner which does not produce undesirable side effects.

SUMMARY OF THE INVENTION

The present invention provides a flameholder with an integrated air mixer designed to satisfy the aforementioned needs. The mixer integrated with the flameholder is extremely light-weight. Pressure losses are almost nil since only a small percent of the hot core gas stream is mixed with the cooler fan air stream. Such mixing produces a very localized increase in the fan air stream temperature at the flameholder which improves fuel vaporization and increases the gas temperature at the trailing edge of the flameholder where stable combustion is most critical. The mixer configuration does not disturb any other functions performed by the flameholder.

Accordingly, the present invention is directed to an improvement in an afterburner of a turbofan engine having a hollow casing defining a fluid flow duct and an elongated flameholder disposed in the casing across the duct for receiving at its front side a hot gas stream flow from a core engine and a cold air stream flow from a fan with droplets of augmentor fuel entrained therein and defining at its rear side a fuel combustion zone. The improvement comprises means in the form of at least one small duct connected to the flameholder, such as a V-shaped gutter thereof, for capturing a small portion of the hot gas stream flow and routing the same outwardly along the gutter of the flameholder. The improvement also comprises means in the form of a deflector plate spaced from the exit end of the duct for deflecting the hot gas exiting therefrom into the cool air fan stream flow for producing a localized increase of the air temperature in the fan stream flow. Such localized air temperature increase enhances the stability of combustion at the rear side of the flameholder.

DETAILED DESCRIPTION OF THE INVENTION

Figure 1:
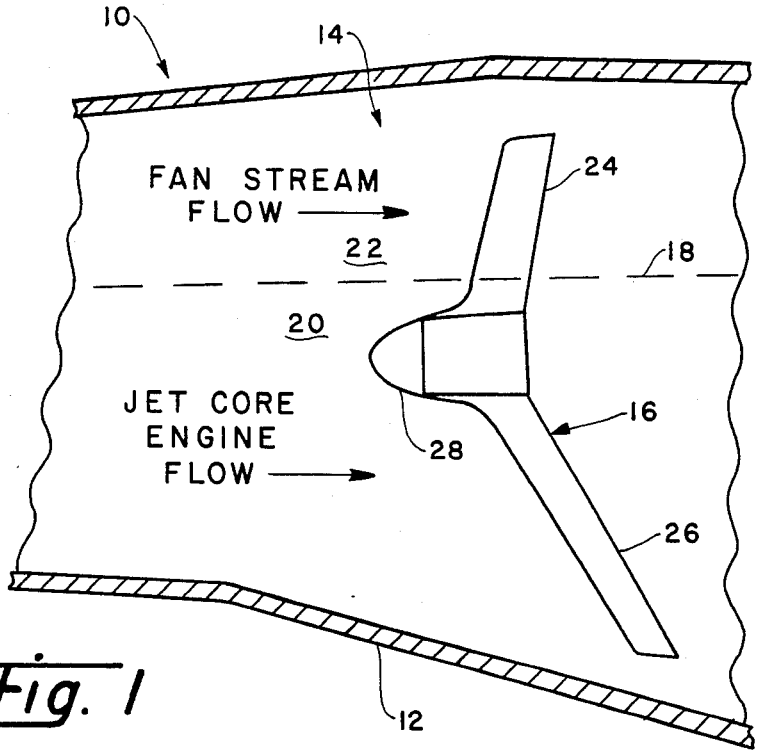
FIG. 1 is a fragmentary axial cross-sectional view of an exemplary turbofan engine afterburner showing in schematical form a flameholder disposed therein.

Referrng now to the drawings, and more particularly to FIG. 1, there is shown an afterburner 10 of a conventional turbofan engine having a hollow casing 12 defining a fluid flow duct 14 and an elongated flameholder 16 disposed in the casing across the duct. The fluid flow within duct 14 is generally divided along imaginary dashed line 18 into a hot gas stream flow 20 from a core engine (not shown) and a cool air stream flow 22 from a fan (not shown). The cool air stream flow has droplets (not shown) of cool augmentor fuel entrained therein.

The flameholder 16 has upper and lower legs 24, 26 which extend in opposite directions generally radially outward and rearward from a central pilot 28 through which the flameholder 16 is connected to the casing by a suitable means not shown in the drawing. Each of the legs 24, 26 has a V-shape and is referred to as a gutter.

The central pilot 28 and lower leg 26 are disposed generally within the hot gas stream flow 20 while the upper leg is mainly disposed within the cool air stream flow 22. The rear side of the upper leg 24 defines a fuel combustion zone.

Figure 4:
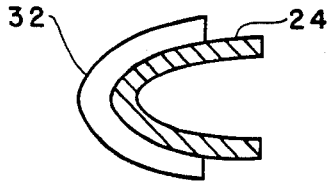
FIG. 4 is an enlarged cross-sectional view of the flameholder taken along line 4—4 of FIG. 2 showing the configuration of the mixer deflector.
Figure 2:
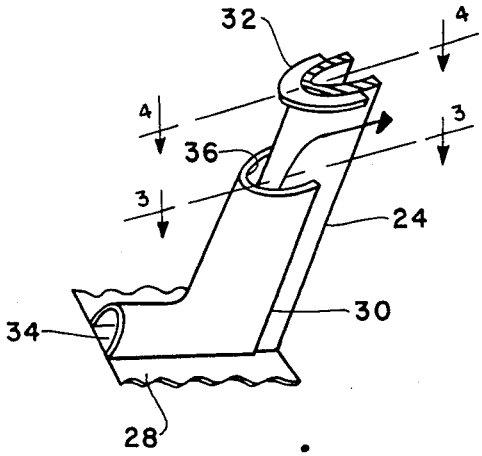
FIG. 2 is an enlarged fragmentary perspective view of the flameholder of FIG. 1 with the improved mixer integrated therewith.
Figure 3:
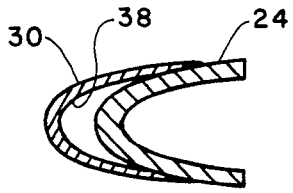
FIG. 3 is an enlarged cross-sectional view of the flameholder taken alone line 3—3 of FIG. 2 showing the configuration of the mixer duct.

Means in the form of a small duct 30 and a deflector plate 32 comprising the improved mixer provided by the present invention are both shown in FIG. 2 and, individually, in respective FIGS. 3 and 4. The small duct 30 is generally L-shaped and mounted on both the central pilot 28 and upper leg 24 of the flameholder 16. In cross-section, the duct 30 is generally V-shaped and faired to merge with the profile of the leg 24 so as to not create any significant additional blockage of the cool air stream flow. The duct 30 defines an inlet 34 disposed generally within the hot gas stream flow and adjacent the central pilot 28, an outlet 36 disposed generally in the cool air stream flow and adjacent the upper leg 24, and a passage 38 closed at its sides and interconnecting the inlet 34 and outlet 36 for routing a small portion of hot gas stream flow, captured at the inlet, from the inlet to the outlet. At the outlet 36, the small portion of hot gas stream flow exits and is deflected by the deflector plate 32 into the cool air stream flow 22 (see arrow emerging from outlet 36 in FIG. 2) into the combustion zone at the rear side of leg 24. The deflector plate 32 is mounted on the upper leg 24 adjacent to, but outwardly spaced from, the outlet 36 of the small duct 30.

It can readily be seen that the duct 30 and deflector plate 32 may be extremely lightweight and provide a mixing action which produces little or no pressure losses since only a small percent or portion of the core engine gas is mixed with the fan air. The routing of air outwardly along the leg 24 results in a very localized increase in air temperature in the stream flow 22 which improves fuel vaporization and increases gas temperature at the trailing or rear side of the leg where stable combustion is most critical.

It is thought that the improved mixer of the present invention and many of its attendant advantages will be understood from the foregoing description and it will be apparent that various changes may be made in the form, construction and arrangement of the parts thereof without departing from the spirit and scope of the invention or sacrificing all of its material advantages the form hereinbefore described being merely a preferred or exemplary embodiment thereof.

Having thus described the invention, what is claimed is:

1. In an afterburner of a turbofan engine having a hollow casing defining a fluid flow duct and an elongated flameholder disposed in said casing across said duct for receiving at its front side a hot gas stream flow from a core engine and a cool air streem flow from a fan with droplets of augmentor fuel entrained therein, said flameholder defining a fuel combustion zone at its rear side and including a central portion disposed in said hot gas stream flow and at least one leg extending radially outward from said central portion and terminating at an outer end spaced inwardly from said casing and disposed in said cool air stream flow, an improved mixer which comprises:

at least one small duct connected to said flameholder for capturing a small portion of said hot gas stream flow and routing the same outwardly along the flameholder, said small duct being generally L-shaped and mounted on both said central portion and leg of said flameholder, said duct defining an inlet adjacent said central portion and within said hot gas stream flow, an outlet adjacent said leg, spaced outwardly from said central portion, spaced inwardly from said casing and said outer end of said flameholder, and disposed within said cool air stream flow, and a passage closed at its sides and interconnecting said inlet and outlet for routing said small portion of said hot gas stream flow to said cool air stream flow, and a deflector which takes the form of a plate connected to said flameholder, spaced from the small duct and disposed in the path of said small portion of said hot gas stream flow routed by said small duct, said deflector plate being mounted on said leg of said flameholder adjacent to, but spaced outwardly from, said outlet of said duct and spaced inwardly from said outer end of said flameholder and said casing for deflecting said small portion of said hot gas stream flow into the path of said cool air stream flow across said flameholder for producing a localized increase in the temperature of the air in fan stream flow adjacent said flameholder and thereby improve stability of combustion at its rear side.

* * * * *